US009459041B2

(12) United States Patent
Park et al.

(10) Patent No.: US 9,459,041 B2
(45) Date of Patent: Oct. 4, 2016

(54) REFRIGERATOR

(71) Applicant: SAMSUNG ELECTRONICS CO., LTD., Suwon-si, Gyeonggi-do (KR)

(72) Inventors: Young Gwi Park, Gwangju (KR); Joo Hee Song, Busan (KR); Yong Seok Kim, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/274,166

(22) Filed: May 9, 2014

(65) Prior Publication Data

US 2014/0246970 A1 Sep. 4, 2014

Related U.S. Application Data

(63) Continuation of application No. 13/926,371, filed on Jun. 25, 2013, now Pat. No. 8,752,919, which is a continuation of application No. 12/461,556, filed on Aug. 14, 2009, now Pat. No. 8,485,617.

(30) Foreign Application Priority Data

Nov. 5, 2008 (KR) ..... 10-2008-109358

(51) Int. Cl.
*F25D 23/02* (2006.01)
*A47B 96/00* (2006.01)
(Continued)

(52) U.S. Cl.
CPC ..... *F25D 29/005* (2013.01); *F25D 23/00* (2013.01); *F25D 23/028* (2013.01); *F25D 29/00* (2013.01); *F25D 2323/023* (2013.01); *F25D 2400/06* (2013.01); *F25D 2400/361* (2013.01)

(58) Field of Classification Search
CPC ..... F25D 23/04; F25D 2400/00; F25D 2400/36; F25D 2400/361; F25D 29/005; F25D 23/00; F25D 23/028; F25D 29/00
USPC ..... 312/401, 405, 405.1, 321.5, 234, 109, 312/326; 62/125, 126, 127, 163
See application file for complete search history.

(56) References Cited

U.S. PATENT DOCUMENTS 3,689,909 A 9/1972 Cotter
4,148,194 A * 4/1979 Kells ..... 62/3.6
(Continued)

FOREIGN PATENT DOCUMENTS

JP 3-18491 2/1991
JP 2000-88445 3/2000
(Continued)

OTHER PUBLICATIONS

U.S. Office Action issued Apr. 3, 2012 in corresponding U.S. Appl. No. 12/461,556.
(Continued)

*Primary Examiner* — James O Hansen
(74) *Attorney, Agent, or Firm* — Staas & Halsey LLP

(57) ABSTRACT

Disclosed is a refrigerator including a main body provided with a storage chamber; a door to respectively open and close the storage chamber; a control unit installed the door to select an operation; a reception part provided in the door to receive the control unit; and an installation hole provided on a side end of the door to cause the control unit to be inserted into the reception part. The control unit is installed through the side end of the door, which is deviated from a user's line of sight.

12 Claims, 7 Drawing Sheets

(51) Int. Cl.
*F25D 29/00* (2006.01)
*F25D 23/00* (2006.01)

(56) References Cited

U.S. PATENT DOCUMENTS

| | | | | |
|---|---|---|---|---|
| 4,358,932 | A | 11/1982 | Helfrich, Jr. | |
| 4,387,578 | A * | 6/1983 | Paddock | 62/127 |
| 4,404,813 | A | 9/1983 | Paddock et al. | |
| 4,966,004 | A | 10/1990 | Midlang et al. | |
| 5,365,959 | A | 11/1994 | Favaro | |
| 6,092,374 | A | 7/2000 | Kang et al. | |
| 6,526,766 | B1 | 3/2003 | Hiraoka et al. | |
| 2001/0039805 | A1 * | 11/2001 | Tavolazzi | 62/125 |
| 2004/0177625 | A1 | 9/2004 | Miller et al. | |
| 2006/0145576 | A1 * | 7/2006 | Lee et al. | 312/406 |
| 2006/0261220 | A1 | 11/2006 | Lee et al. | |
| 2008/0006042 | A1 | 1/2008 | Lee | |
| 2008/0047287 | A1 | 2/2008 | Ruppert | |

FOREIGN PATENT DOCUMENTS

| | | |
|---|---|---|
| JP | 2001-153538 | 6/2001 |
| JP | 2006-153357 | 6/2006 |
| KR | 10-0644253 | 11/2006 |
| KR | 10-2006-0133763 | 12/2006 |
| KR | 10-2007-0034835 | 3/2007 |

OTHER PUBLICATIONS

U.S. Office Action issued Sep. 27, 2012 in corresponding U.S. Appl. No. 12/461,556.

U.S. Notice of Allowance issued Mar. 14, 2013 in corresponding U.S. Appl. No. 12/461,556.

U.S. Office Action issued Oct. 4, 2013 in corresponding U.S. Appl. No. 13/926,371.

U.S. Notice of Allowance issued Feb. 4, 2014 in corresponding U.S. Appl. No. 13/926,371.

U.S. Appl. No. 13/926,371, filed Jun. 25, 2013, Young Gwi Park et al., SAMSUNG ELECTRONICS CO., LTD.

Korean Office Action dated Jul. 21, 2014 in correspondence to Korean Patent Application No. 10-2008-0109358.

Korean Office Action issued Feb. 16, 2015 in corresponding Korean Patent Application No. 10-2008-0109358.

Notice of Allowance mailed Dec. 28, 2015 in Korean Patent Application No. 10-2008-0109358.

* cited by examiner

REFRIGERATOR

CROSS-REFERENCE TO RELATED APPLICATIONS

This application is a continuation of U.S. Pat. No. 8,752,919 issued on Jun. 17, 2014, which is a continuation of U.S. Pat. No. 8,485,617, issued on Jul. 16, 2013 in the U.S. Patent and Trademark Office, which claims the benefit of Korean Patent Application No. 10-2008-0109358, filed on Nov. 5, 2008 in the Korean Intellectual Property Office, the entire disclosures of which are incorporated herein by reference.

BACKGROUND

1. Field

The present invention relates to a refrigerator, and more particularly to a refrigerator with a control unit to select an operation of the refrigerator.

2. Description of the Related Art

In general, a refrigerator is an apparatus, which includes constituent elements of a refrigerating cycle, and stores objects in a cold state or a frozen state with cold air generated through the constituent elements of the refrigerating cycle.

The refrigerator includes a main body forming storage chambers, such as a freezing chamber and a refrigerating chamber, and doors to open and close the storage chambers. A display unit to display the operating state of the refrigerator and a control unit including buttons to allow a user to select an operation of the refrigerator are installed on the front surface of one of the doors.

In the conventional refrigerator, an installation part, at which the control unit is installed, is provided on the front surface of the door, and the control unit is fixed to the installation part through connection members, such as screws. Then a cover having an area large enough to cover the installation part exposed through the circumference of the control unit is installed on the installation part.

When that the control unit is installed on the front surface of the door, the boundary between the control unit and the cover invariably forms a line, and thus the design of the front surface of the door is restricted by the control unit and it is difficult to obtain different designs of the door.

Further, the cover installed on the installation part must to have a larger size than that of the control unit such that the cover can sufficiently cover the circumference of the control unit, and thus the production cost of the door is increased.

SUMMARY

Accordingly, it is an aspect of the present invention to provide a refrigerator, which has different designs of a door forming the front surface of the refrigerator and also reduces the production cost.

Additional aspects and/or advantages will be set forth in part in the description which follows and, in part, will be apparent from the description, or may be learned by practice of the invention.

The foregoing and/or other aspects of the present invention are achieved by providing a refrigerator including a main body defining at least one storage chamber; at least one door including a door frame forming an external shape of the door and a heat insulating member filling an inner space of the door frame, the door to respectively open and close the storage chamber; a control unit installed in the door to select an operation; a partition frame formed integrally with the door frame to form a reception part such that the reception part is divided from the inner space of the door frame filled with the heat insulating member; and an installation hole formed on a side end of the door to cause the control unit to be inserted into the reception part.

The refrigerator may further include a cover installed at the installation hole to close the installation hole. Switches to select the operation and display units to display an operating state of the refrigerator may be provided on the front surface of the control unit.

The refrigerator may further include a transparent member installed in front of the door to form the front surface of the door, and a transparent window part to show the display units to the outside of the door may be provided at a position of the transparent member corresponding to the display units.

The switches may include electrostatic switches operated by static electricity. One side end of the door may be rotatably installed on the main body; and the installation hole may be provided on the other side end of the door. A handle groove may be provided on the cover.

The refrigerator may further include guide parts provided on the rear surface of the reception part and slantingly protruded toward the front portion of one side part of the door to guide the control unit forward.

A pair of hooks latched into the installation hole to maintain the installation state of the cover in the installation hole may be formed at both sides of the cover.

First support protrusions to support the side surfaces of the control unit and second support protrusions to support the rear surface of the control unit may be provided on the cover.

The foregoing and/or other aspects of the present invention may also be achieved by providing a refrigerator including a main body defining at least one storage chamber; at least one door including a door frame forming an external shape of the door and a heat insulating member filling an inner space of the door frame, the door to respectively open and close the storage chamber; a sub storage chamber to provide access to stored objects without opening the door; a sub door to open and close the sub storage chamber; a control unit installed in the door to select an operation; a partition frame formed integrally with the door frame to form a reception part such that the reception part is divided from the inner space of the door frame filled with the heat insulating member; and an installation hole formed through an upper surface of the sub storage chamber to cause the control unit to be inserted into the reception part.

The refrigerator may further include a cover installed at the installation hole to close the installation hole.

The cover may be installed at the lower end of a connection part extended downwardly from the lower end of the control unit, and thus move together with the control unit and be inserted into the installation hole.

The refrigerator may further include guide parts provided on the rear surface of the reception part and slantingly protruded toward the front portion of the upper part of the door to guide the control unit forward.

A pair of hooks latched into the installation hole to maintain the installation state of the cover in the installation hole may be formed at both sides of the cover.

A first elastic support part protruding forward to elastically support the control unit forward may be provided on the rear surface of the reception part.

A second elastic support part protruding backward to elastically support the rear surface of the control unit may be provided on the cover.

BRIEF DESCRIPTION OF THE DRAWINGS

These and/or other aspects and advantages will become apparent and more readily appreciated from the following description of the embodiments, taken in conjunction with the accompanying drawings in which.

DETAILED DESCRIPTION OF EMBODIMENTS

Figure 1:
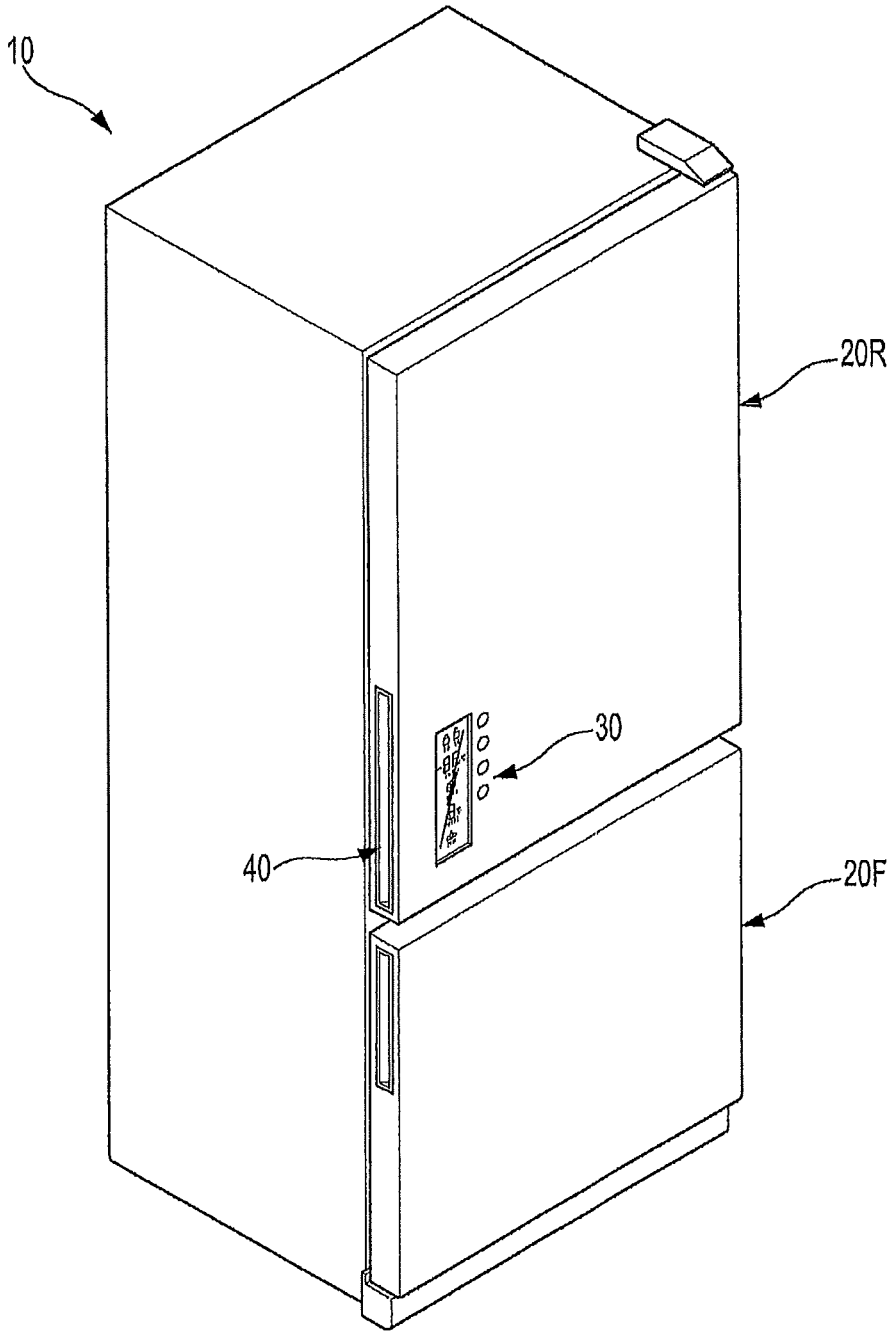
FIG. 1 is a perspective view of a refrigerator in accordance with a first embodiment of the present invention.

Reference will now be made in detail to the embodiments, examples of which are illustrated in the accompanying drawings, wherein like reference numerals refer to like elements throughout. The embodiments are described below to explain the present invention by referring to the annexed drawings.

Hereinafter, a refrigerator in accordance with a first embodiment of the present invention will be described in detail.

Figure 2:
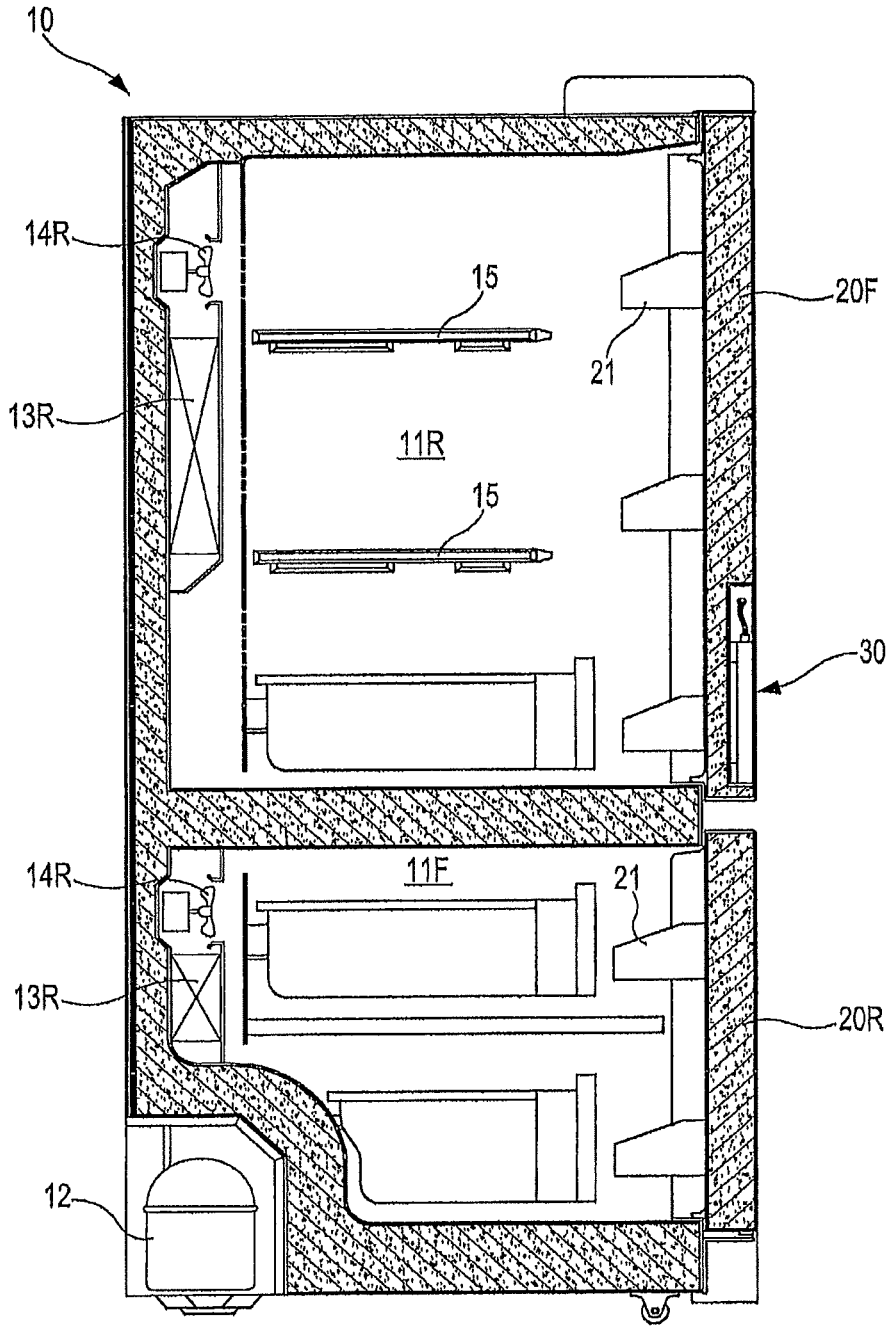
FIG. 2 is a longitudinal-sectional view of the refrigerator in accordance with the first embodiment of the present invention.

As shown in FIGS. 1 and 2, the refrigerator in accordance with this embodiment includes a main body 10 forming the external appearance of the refrigerator and provided with storage chambers 11R and 11F, front surfaces of which are opened to store objects therein, and doors 20R and 20F, side ends of which are rotatably installed at one side end of the main body 10 to open and close the storage chambers 11R and 11F. The storage chambers 11R and 11F include a refrigerating chamber 11R to store objects in a cold state and a freezing chamber 11F to store objects in a frozen state, and the doors 20R and 20F include a refrigerating chamber door 20R to open and close the refrigerating chamber 11R and a freezing chamber door 20F to open and close the freezing chamber 11F.

A compressor 12 to compress a refrigerant is installed in the lower region of the rear portion of the main body 10. A refrigerating chamber evaporator 13R and a freezing chamber evaporator 13F to generate cold air are installed in the rear of the refrigerating chamber 11R and freezing chamber 11F, respectively. A refrigerating chamber air flower fan 14R and a freezing chamber air flower fan 14F to generate suction force and blowing force to circulate the cold air generated from the refrigerating chamber evaporator 13R and the freezing chamber evaporator 13F into the refrigerating chamber 11R and the freezing chamber 11F are also respectively installed at the rear portions of the refrigerating chamber 11R and the freezing chamber 11F. A plurality of racks 15 to effectively divisionally store many objects is disposed in the refrigerating chamber 11R and the freezing chamber 11F, and a plurality of door racks 21 to store cans or drink bottles are disposed on the inner surfaces of the refrigerating chamber door 20R and the freezing chamber door 20F.

Figure 3:
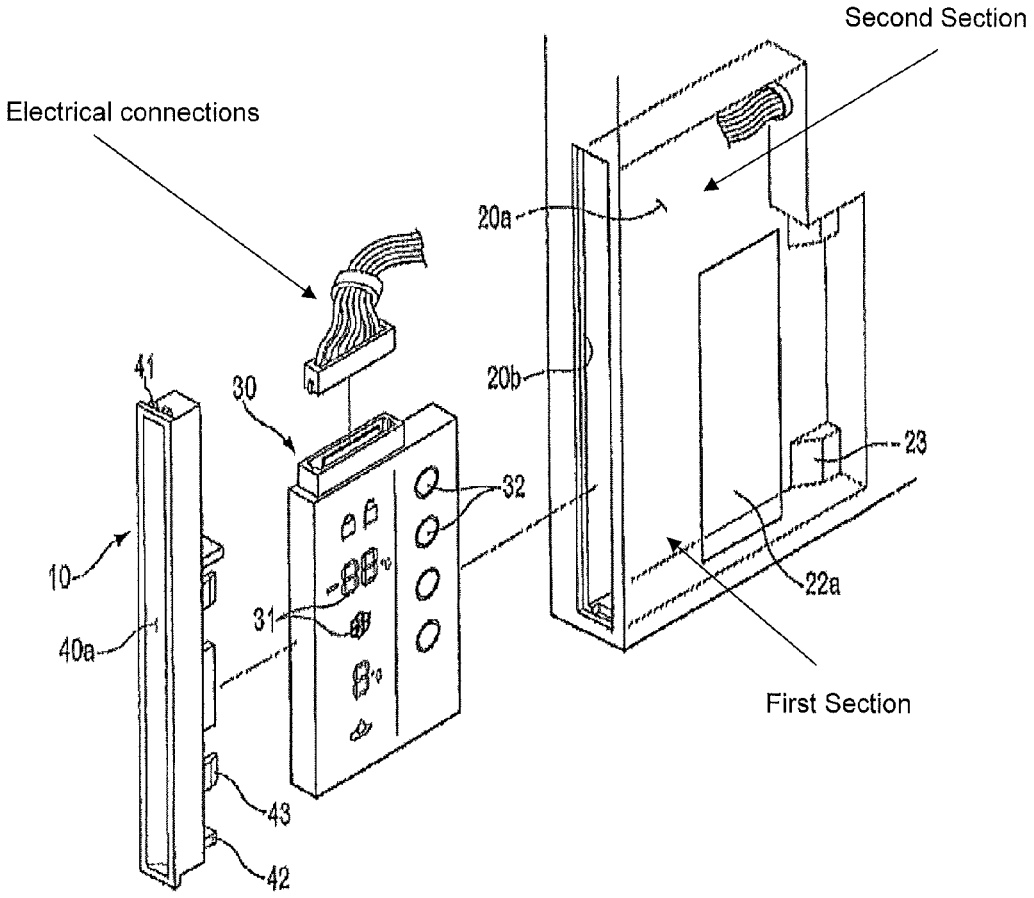
FIG. 3 is a perspective view of a control unit applied to the refrigerator in accordance with the first embodiment of the present invention.
Figure 4:
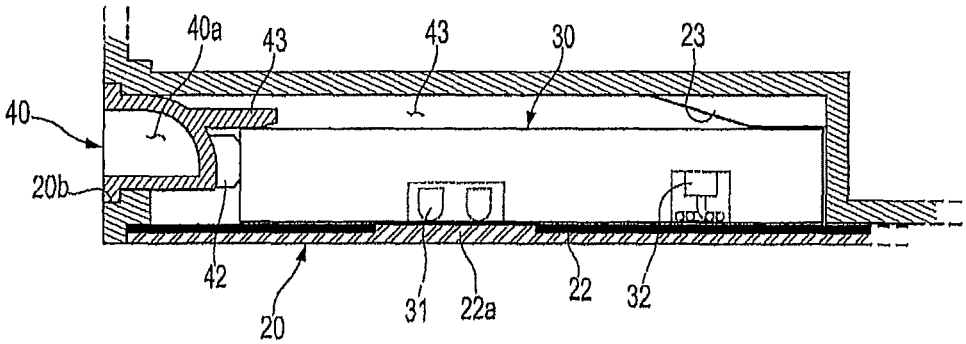
FIG. 4 is a transverse-sectional view illustrating the installation state of the control unit applied to the refrigerator in accordance with the first embodiment of the present invention.

A control unit 30 to allow a user to select an operation of the refrigerator is installed in the refrigerating chamber door 20R. As shown in FIGS. 3 and 4, a plurality of display units 31 to display a temperature or a selected operating state and a plurality of switches 32 to allow the user to select the operation of the refrigerator are disposed on the front surface of the control unit 30, and thus the user selects the operation of the refrigerator through the switches 32 of the control unit 30 and confirms the operating state through the display units 31 of the control unit 30.

The front surface of the refrigerating chamber door 20R is made of a transparent member 22, such as tempered glass, in consideration of the aesthetic appearance of the refrigerator A transparent window part 22*a* to show the display units 31 to the outside of the refrigerating chamber door 20R is formed at a portion of the transparent member 22 at a position corresponding to the display units 31 of the control unit 30 installed in a reception part 20*a*, which will be described later. The refrigerating chamber door 20R includes a door frame 201 forming the external shape of the refrigerating chamber door 20R and a heat insulating member 202 (with reference to FIG. 2) made of a foamed resin and filling the inside of the door frame 201.

The control unit 30 is installed such that the front surface of the control unit 30 contacts the inner surface of the transparent member 22 forming the front surface of the refrigerating chamber door 20R, and the switches 32 of the control unit 30 are electrostatic switches, which sense static electricity. Therefore, when a user's hand contacts a region of the transparent member 22 corresponding to the position of one of the switches 32, static electricity is transferred to the switch 32 due to the contact of the user's hand with the transparent member 22, and thus the switch 32 is operated in a touch mode.

In order to install the control unit 30 in the refrigerating chamber door 20R, the reception part 20*a*, in which the control unit 30 is received, and an installation hole 20*b*, through which the control unit 30 is received in the reception part 20*a*, are provided in the refrigerating chamber door 20R. A cover 40 to close the installation hole 20*b* is installed at the installation hole 20*b*. In this embodiment, the installation hole 20*b* is provided in the other side end of the refrigerating chamber door 20R, one side end of which is rotatably installed at the main body 10.

In this embodiment, the reception part 20*a* is divided from the inner space of the door frame 201, filled with the heat insulating member 202, by a partition frame 203 integrally extended inwardly from the door frame 201, and thus the partition frame 203 prevents the foamed resin from being introduced into the reception part 20*a* during a process of forming the heat insulating member 202 within the door frame 20.

Guide parts 23, which are slantingly protruded toward the front portion of one side part of the refrigerating chamber door 20R to guide the control unit 30, coming into the reception part 20*a* through the installation hole 20*b*, forward, are formed on the partition frame 203 forming the rear surface of the reception part 20*a*. Therefore, the front surface of the control unit 30 contacts the rear surface of the transparent member 22 through the guide parts 23.

A handle groove 40*a* to cause a user to easily grip the refrigerating chamber door 20R is dented into the cover 40, and thus the cover 40 serves as a handle of the refrigerating chamber door 20R. Hooks 41 to maintain the installation state of the cover in the installation hole 20*b* are respectively formed at the upper and lower ends of the cover 40. Further, first support protrusions 42 to support the side surfaces of the control unit 30 installed in the reception part 20*a* and second support protrusions 43 to support the rear surface of the control unit 30 are formed on the inner surface of the cover 40.

Therefore, the control unit 30 is installed in the reception part 20*a* under the condition that one side end of the control unit 30 is supported by the guide parts 23, the other side end of the control unit 30 is supported by the first support protrusions 42 and the second protrusions 43, and thus the front surface of the control unit 30 contacts the transparent member 22 forming the front surface of the refrigerating chamber door 20R.

When the installation hole 20*b* is formed on one side end of the refrigerating chamber door 20R, as described above, the installation hole 20*b* and the cover 40 have a small area corresponding to the area of the side end of the control unit 30, and thus the amount of a material for the cover 40 is reduced. Further, the installation hole 20*b* and the cover 40 located at the side end of the refrigerating chamber door 20R cannot be seen by a user generally located in front of the refrigerator, and thus it is possible to prevent the lowering of the external appearance of the refrigerator by the installation hole 20*b* and the cover 40.

Although this embodiment describes the installation hole 20*b*, which is provided on the other side end of the refrigerating chamber door 20R, one side end of which is rotatably installed at the main body 10, the installation hole 20*b* may be provided on any one of both side ends, an upper end, and a lower end of the refrigerating chamber door 20R or the freezing chamber door 20F.

Hereinafter, a refrigerator in accordance with a second embodiment of the present invention will be described in detail.

Figure 5:
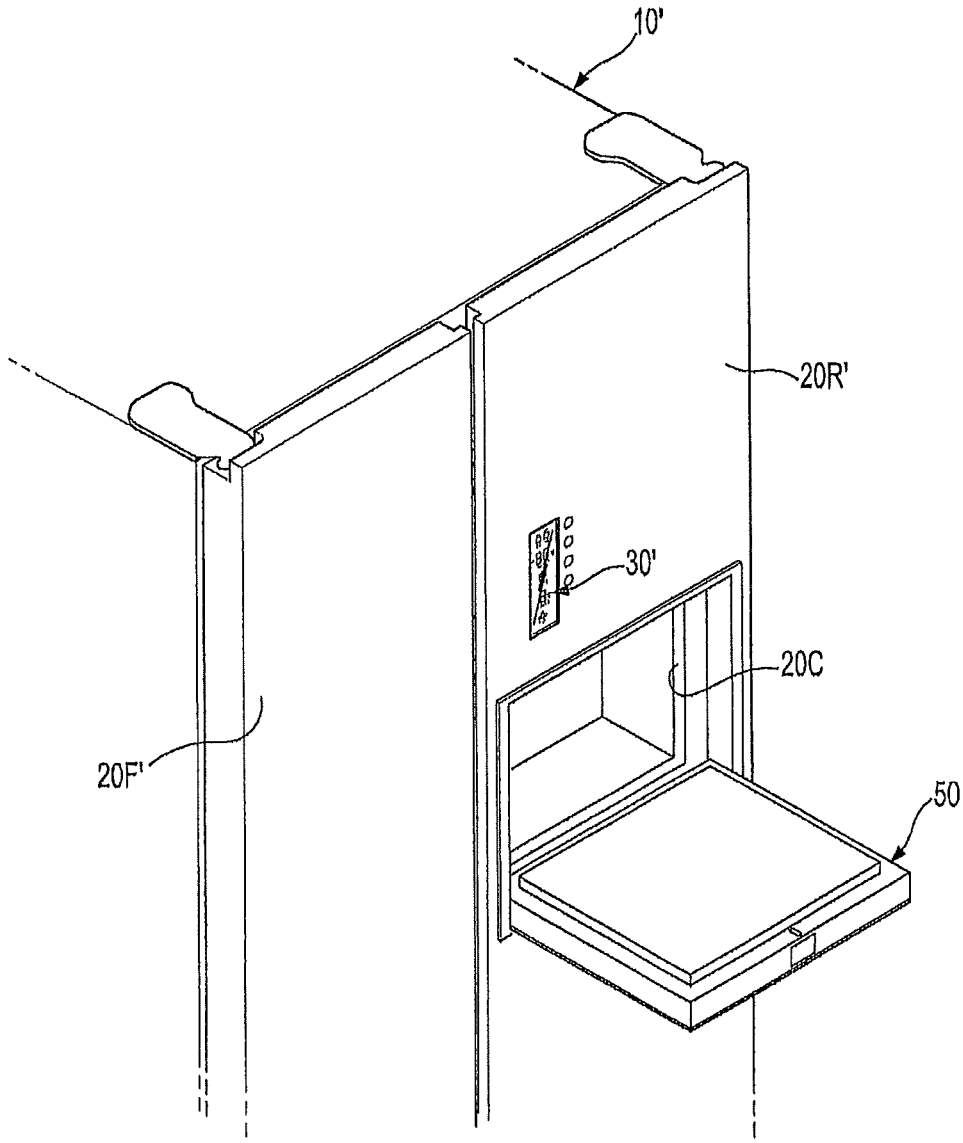
FIG. 5 is a perspective view of a refrigerator in accordance with a second embodiment of the present invention.

As shown in FIG. 5, the refrigerator in accordance with this embodiment includes a sub storage chamber 20C formed in the refrigerating chamber door 20R'. This allows stored objects to be taken out without opening a refrigerating chamber door 20R', and a sub door 50 to open and close the sub storage chamber 20C.

The refrigerating chamber door 20R' includes a door frame 201' forming the external shape of the refrigerating chamber door 20R' and a heat insulating member 202 (with reference to FIG. 2) made of a foamed resin and filling the inside of the door frame 201'.

Figure 6:
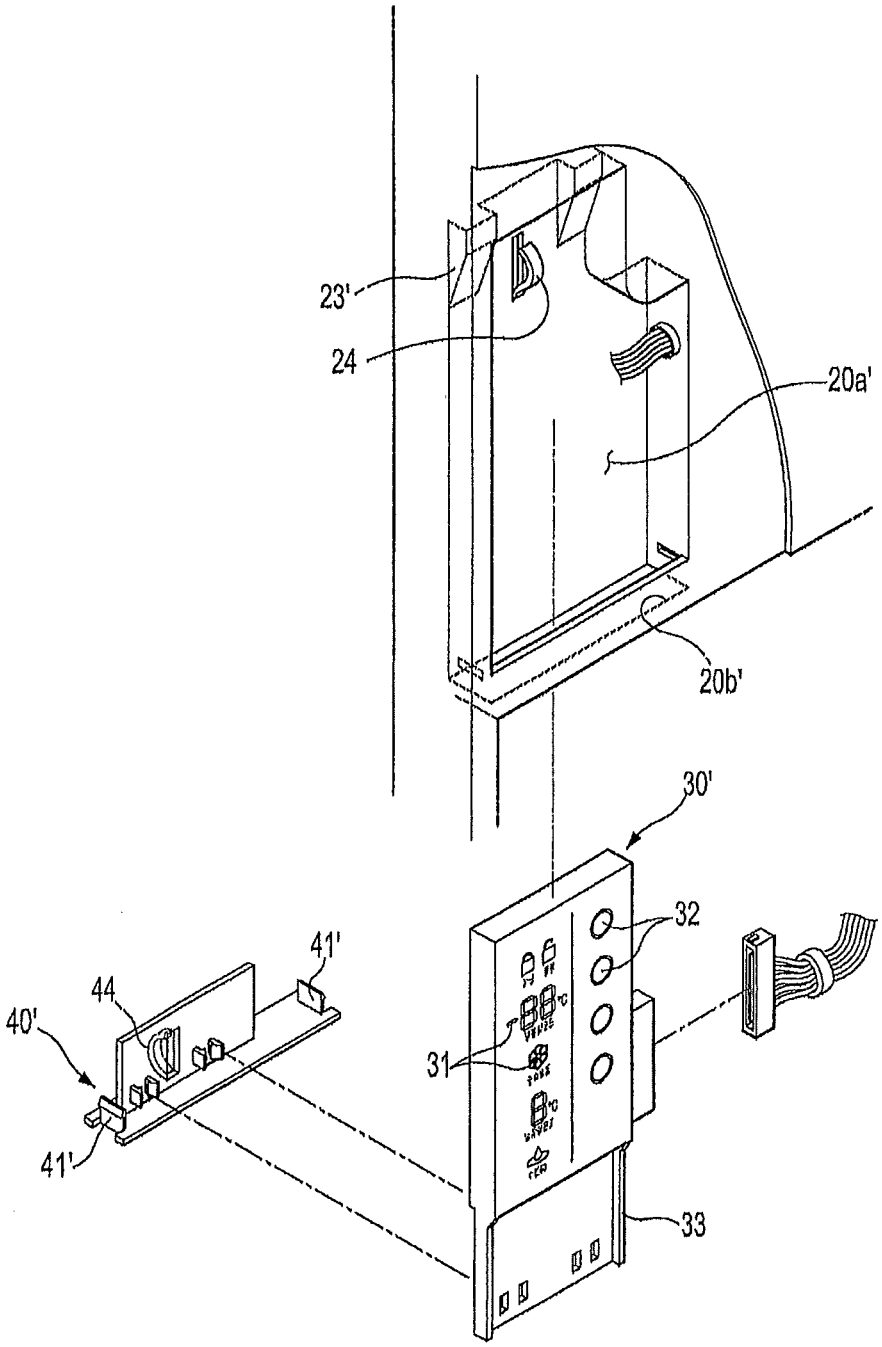
FIG. 6 is a perspective view of a control unit applied to the refrigerator in accordance with the second embodiment of the present invention.
Figure 7:
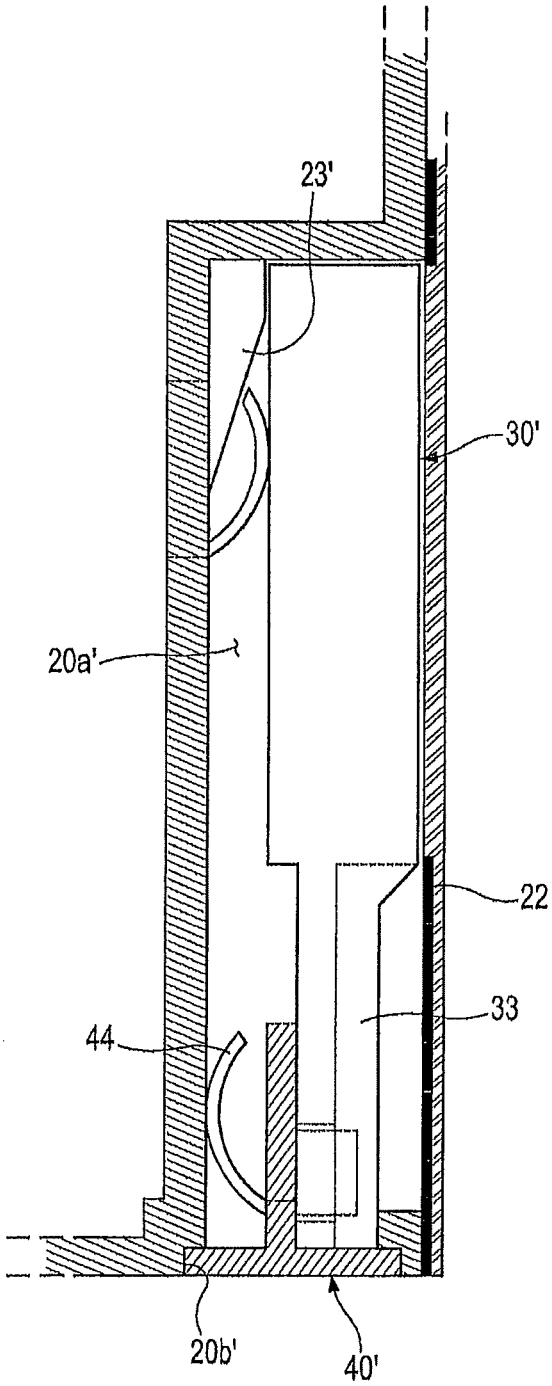
FIG. 7 is a longitudinal-sectional view illustrating the installation state of the control unit applied to the refrigerator in accordance with the second embodiment of the present invention.

As shown in FIGS. 6 and 7, a control unit 30' is installed above the sub storage chamber 20C, and a reception part 20*a*', in which the control unit 30' is received, and an installation hole 20*b*', through which the control unit 30' is received in the reception part 20*a*', are provided in the refrigerating chamber door 20R'. A cover 40' to close the installation hole 20*b*' is installed at the installation hole 20*b*'. In this embodiment, the installation hole 20*b*' is provided in the upper surface of the sub storage chamber 20C.

In this embodiment, the reception part 20*a*' is divided from the inner space of the door frame 201', filled with the heat insulating member 202, by a partition frame 203' integrally extended inwardly from the door frame 201', and thus the partition frame 203' prevents the foamed resin from being introduced into the reception part 20*a*' during a process of forming the heat insulating member 202 within the door frame 201'.

Guide parts 23', slantingly protrude toward the front portion of the upper part of the refrigerating chamber door 20R' to guide the control unit 30', coming into the reception part 20*a*' through the installation hole 20*b*', forward. A first elastic support part 24, the cross section of which has an arc shape, to elastically support the rear surface of the control unit 30', is formed on the partition frame 203' forming the rear surface of the reception part 20*a*.

A connection part 33 extended downwardly from the control unit 30' is connected to the cover 40', and allows the cover 40' and the control unit 30' to move together and to be installed in the installation hole 20*b*'. Hooks 41' to maintain the installation state of the cover 40' in the installation hole 20*b*' are respectively formed at both sides the cover 40'. Further, a second elastic support part 44, which is protruded backward from the cover 40 and is supported by the rear surface of the reception part 20*a*', is provided on the cover 40'.

Therefore, the control unit 30' is installed in the reception part 20*a*' under the condition that the upper portion of the control unit 30' is supported by the guide parts 23' and the first elastic support part 24, the lower portion of the control unit 30' is supported by the second elastic support part 44, and thus the front surface of the control unit 30' contacts the transparent member 22 forming the front surface of the refrigerating chamber door 20R'.

When the installation hole 20*b*' is formed through the upper surface of the sub storage chamber 20*c*, as described above, the installation hole 20*b*' and the cover 40' cannot be seen by a user of the refrigerator. Particularly, when the sub storage chamber 20*c* is closed by the sub door 50, the installation hole 20*b*' and the cover 40' are covered up by the sub door 50 and thus are completely unseen.

As described above, in the refrigerator in accordance with the embodiment of the present invention, the control unit is installed through the side end of the door, which is deviated from a user's sight, and thus does not influence the front design of the door, thereby achieving various front designs of the door.

Further, in the refrigerator in accordance with the embodiment of the present invention, the installation hole has a small area corresponding to that of the side surface of the control unit, and the installation hole and the cover are not seen from an area in front of the refrigerator, thereby further enhancing the external appearance of the refrigerator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body defining at least one storage chamber;

at least one door including a door frame having a left plate, a right plate, a top plate and a bottom plate for forming an external shape of the at least one door and a heat insulating member filling an inner space of the door frame;

a control unit installed in the at least one door to select an operation of the refrigerator;

a partition frame formed within the door frame to form a reception part such that the reception part is divided from the inner space of the door frame filled with the heat insulating member;

an installation hole formed on at least one of the left, right, top and bottom plates of the door so that the control unit can be inserted into the reception part;

at least one guide part to guide the control unit while being inserted into the reception part; and a cover installed at the installation hole to close the installation hole, the cover comprising a support protrusion to support a surface of the control unit, wherein the reception part comprises a first section in which the control unit is installed and a second section in which a connector is electrically connected to the control unit, and wherein the second section is provided above the control unit and has a cross section that is smaller than a cross section of the first section that faces the second section.

2. The refrigerator according to claim 1, further comprising switches to select the operation of the refrigerator and at least one display units to display an operating state of the refrigerator, the switches and the at least one display units being provided on a front surface of the control unit.

3. The refrigerator according to claim 2, further comprising a transparent member installed in a front of the at least one door, wherein a transparent window part to show the at least one display units to outside of the at least one door is provided at a position of the transparent member corresponding to the at least one display units.

4. The refrigerator according to claim 2, wherein the switches include electrostatic switches operated by static electricity.

5. The refrigerator according to claim 1, wherein:

a first side of the door is rotatably installed on the main body; and the installation hole is provided on a second side of the door opposite the first side.

6. The refrigerator according to claim 1, further comprising a handle groove provided on the cover.

7. The refrigerator according to claim 1, wherein the first section comprises the at least one guide part spaced apart from the second section.

8. The refrigerator according to claim 1, wherein the first section limits vertical movement of the control unit.

9. The refrigerator according to claim 1, wherein the installation hole allows for access to the second section to allow the control unit to be connected to the connector.

10. The refrigerator according to claim 9, wherein the cover has a length to enclose the installation hole for both the first and second sections of the reception part.

11. The refrigerator according to claim 1, wherein the cover includes a pair of hooks latched into the installation hole to maintain an installation state of the cover in the installation hole, the hooks being formed at respective sides of the cover.

12. A refrigerator comprising:

a main body defining at least one storage chamber;

at least one door including a door frame having a left plate, a right plate, a top plate and a bottom plate for forming an external shape of the at least one door and a heat insulating member filling an inner space of the door frame;

a control unit installed in the at least one door to select an operation of the refrigerator;

a partition frame formed within the door frame to form a reception part such that the reception part is divided from the inner space of the door frame filled with the heat insulating member;

an installation hole formed on at least one of the left, right, top and bottom plates of the door so that the control unit can be inserted into the reception part;

at least one guide part to guide the control unit while being inserted into the reception part; and a cover installed at the installation hole to close the installation hole, wherein the reception part comprises a first section in which the control unit is installed and a second section in which a connector is electrically connected to the control unit, and wherein the second section is provided at one side of the control unit and has a cross section that is smaller than a cross section of the first section that faces the second section, wherein the cover comprises at least one support protrusion to support a side surface of the control unit and at least one support protrusion to support a rear surface of the control unit.

* * * * *